US005941754A

United States Patent [19]

Maxim

[11] Patent Number: 5,941,754

[45] Date of Patent: Aug. 24, 1999

[54] ELECTRICALLY POWERED MINIATURE VEHICLE WITH WATER DRAIN ACTIVATION TIMING MODULE AND REAR WHEEL LIFT MECHANISM

[76] Inventor: John G. Maxim, 863 Coventry St., Boca Raton, Fla. 33487-3106

[21] Appl. No.: 08/971,269

[22] Filed: Nov. 17, 1997

[51] Int. Cl.[6] ..... A63H 29/14; A63H 17/00

[52] U.S. Cl. ..... 446/267; 446/176; 446/431; 446/465

[58] Field of Search ..... 446/166, 176, 446/267, 429, 457, 465, 431

[56] References Cited

U.S. PATENT DOCUMENTS

| | | | |
|---|---|---|---|
| 2,832,177 | 4/1958 | Mueller | 446/462 |
| 3,498,131 | 3/1970 | Rickey | 73/304 R |
| 3,621,607 | 11/1971 | Morrison et al. | 46/206 |
| 3,803,756 | 4/1974 | Strongin | 46/202 |
| 3,886,682 | 6/1975 | Ieda et al. | 46/202 |
| 4,347,683 | 9/1982 | Maxim | 446/267 |
| 4,363,186 | 12/1982 | Goldfarb et al. | 46/209 |
| 4,373,290 | 2/1983 | Goldfarb et al. | 46/44 |
| 4,476,648 | 10/1984 | Maxim | 446/166 |
| 4,498,886 | 2/1985 | Goldfarb et al. | 446/202 |
| 4,511,342 | 4/1985 | Hart et al. | 446/429 |
| 4,526,554 | 7/1985 | Goldfarb et al. | 446/429 |
| 4,547,169 | 10/1985 | Maxim | 446/267 |
| 4,701,150 | 10/1987 | Alvarez | 446/423 |

FOREIGN PATENT DOCUMENTS

| | | | |
|---|---|---|---|
| 1104215 | 11/1955 | France | 446/429 |
| 678578 | 7/1939 | Germany | 446/429 |

*Primary Examiner*—Kien T. Nguyen
*Assistant Examiner*—Michael B. Priddy
*Attorney, Agent, or Firm*—Oltman, Flynn & Kubler

[57] ABSTRACT

A vehicle for entertainment includes a chassis with several support wheels, where at least one of support wheels is a drive wheel, an electric motor drivably connected to the drive wheel, an electric power source, a power supply circuit interconnecting the power source and the motor, for selectively delivering electric power from the power source to the motor, including power circuit first and second terminals, and an activation duration limiting module within the power supply circuit and timed by liquid draining from a drain vessel, where the presence of a sufficient quantity of the liquid in the vessel causes the power circuit terminals to make electrical contact with each other and thereby completes the power circuit, activating the motor, and where the circuit remains complete and the motor activated until enough of the liquid has drained from the vessel to decrease the quantity of the liquid to a level below the sufficient quantity, and thereby causes the power circuit terminals to electrically disconnect.

18 Claims, 4 Drawing Sheets

ELECTRICALLY POWERED MINIATURE VEHICLE WITH WATER DRAIN ACTIVATION TIMING MODULE AND REAR WHEEL LIFT MECHANISM

BACKGROUND OF THE INVENTION

1. Field of the Invention

The present invention relates generally to the field of toys and novelty items including scale models and miniatures of larger items. More specifically the present invention relates to a miniature vehicle such as an automobile or a truck, including a chassis with support wheels, a hollow shell body, an electric motor of conventional design drivably connected to a rear support wheel, a battery and a power supply circuit for delivering electric current to the motor including an activation duration setting module timed by the draining of liquid from a module vessel. A lift mechanism is preferably provided to elevate the rear wheels while the liquid is being poured into the vessel, to permit complete filling of the vessel without spillage and to cause a wheel spinning burn-out or wheel standing acceleration.

The module is seated within the vehicle body, and the liquid is poured into the vessel through a filling tube made to resemble a gasoline fill tube. The presence of a sufficient quantity of the liquid in the vessel causes the power circuit terminals to make electrical contact with each other and thereby completes the power circuit, activating the motor, and the circuit remains complete and the motor activated until enough of the liquid has drained from the vessel to decrease the quantity of the liquid to a level below the sufficient quantity, and thereby causes the power circuit terminals to electrically disconnect.

2. Description of the Prior Art

Toy and miniature vehicles containing electrical and mechanical power sources and having drive wheel elevating launch structures have been known for several years.

Morrison, et al., U.S. Pat. No. 3,621,607, issued on Nov. 23, 1971, discloses a self-propelled toy vehicle. The Morrison, et al. vehicle has a single supporting wheel which is also a flywheel. Energy is stored in the flywheel by wrapping a cord around the flywheel axle and pulling the cord. The flywheel is elevated from the vehicle support surface during cord pulling by a launching structure. The launching structure includes a platform having a pair of spaced-apart and parallel vertical support walls. The vehicle is placed on the launcher so that lateral portions of the vehicle rest on the support walls. The flywheel axle cord is pulled and, while the flywheel is spinning, a lever on the launching structure is pivoted against the rear of the vehicle to push it off the support walls for rapid acceleration. Morrison, et al. lacks the appeal of realism, because one stores power in a full-scale, actual vehicle by pouring gasoline into it, not by pulling a cord wound around an axle.

Strongin, U.S. Pat. No. 3,803,756, issued on Apr. 16, 1974, reveals a toy vehicle and a vehicle launching device. Strongin includes a toy automobile containing a flywheel for storing rotational energy, and a launching device which elevates the flywheel from the support surface and spins the flywheel. The launching device includes a ramp on which the vehicle is placed, an electric motor connected to a clutch which releasibly engages and spins a laterally directed shaft on the vehicle which in turn imparts rotational speed to the flywheel. The vehicle is slid laterally on the ramp toward the clutch, and sliding in this direction causes follower elements to ride upwardly on a cam ramp surface and elevate the vehicle and its flywheel. After rotational energy is stored, the vehicle is slid laterally in the other direction and the configuration of the cam surface lowers the vehicle and flywheel into contact with the ramp support surface for quick acceleration. The problem of Morrison, et al. is again presented because one does not power a real vehicle by placing it on a flywheel spinning launching device. Another problem is that the ramp launching device is not part of the vehicle and must be kept together with at all times. Still another problem is that the ramp launching device is probably as costly to produce as the vehicle itself and thus significantly elevates not only the vehicle but also its sales price.

Ieda, et al., U.S. Pat. No. 3,886,682, issued on Jun. 3, 1975, teaches a toy motorcycle and launching structure much like that of Strongin. The toy motorcycle is placed on the ramp of the launch structure, the drive wheel is elevated and a motor-powered gear protruding from the ramp engages and spins a gear in the motorcycle. The gear in the motorcycle is connected to a flywheel which gathers rotational energy to drive the motorcycle. When enough energy has been stored, the drive wheel is lowered and the motorcycle accelerates rapidly off the ramp. The problems of Strongin are again presented.

Hart, et al., U.S. Pat. No. 4,511,342, issued on Apr. 16, 1985, discloses a winding and launching device for toy vehicles. The Hart, et al. winding and launching device includes a base covered by a shell. The shell has an outwardly projecting shaft adapted to mate with a coupling on a flywheel-driven toy vehicle for rotating the flywheel. The shaft is rotated at high speed through a step-up gearing arrangement with a crank positioned on the shell. A button protrudes from the shell and is connected to a platform which holds the shaft in place, and depressing the button pulls the shaft from the vehicle coupling so that the vehicle is freed to speed away. The problems of Strongin are still again presented.

A series of patents issued to Goldfarb, et al. teach variations of a toy vehicle and launching structure, including U.S. Pat. No. 4,363,186 issued on Dec. 14, 1982 for a toy motorcycle and launcher; U.S. Pat. No. 4,526,554, issued on Jul. 2, 1985, for a toy motorcycle and launching apparatus; U.S. Pat. No. 4,373,290, issued on Feb. 15, 1983, for a wheeled turbine-powered toy vehicle and launcher apparatus; and U.S. Pat. No. 4,498,886, issued Feb. 12, 1985, for a wheeled turbine-powered toy vehicle and launching apparatus. Each of these patents discloses a toy vehicle containing a flywheel which is spun to store energy, either by blowing air into a turbine assembly or by pulling a toothed rack over a gear. Each further includes a flywheel or drive wheel elevating launching structure. The several problems of Hart et al. are presented.

It is thus an object of the present invention to provide an electric motor powered miniature vehicle which is activated by pouring a liquid from a miniature gasoline can shaped container into an opening in the vehicle body resembling a fuel opening on an actual full-scale vehicle.

It is another object of the present invention to provide such a vehicle for which the activation duration is selectable in direct proportion to the quantity of liquid poured into the fuel opening with a removable and replaceable module.

It is still another object of the present invention to provide such a vehicle which includes means integral with the vehicle for elevating the drive wheel during liquid pouring so that pouring is not interrupted by vehicle acceleration, which also rapidly lowers the drive wheel for an exciting spinning wheel patch-out start.

It is finally an object of the present invention to provide such a vehicle which is entertaining, sturdy, long-lived and relatively inexpensive to manufacture.

SUMMARY OF THE INVENTION

The present invention accomplishes the above-stated objectives, as well as others, as may be determined by a fair reading and interpretation of the entire specification.

A vehicle for entertainment is provided, including a chassis with several support wheels, where at least one of support wheels is a drive wheel, an electric motor drivably connected to the drive wheel, an electric power source, a power supply circuit interconnecting the power source and the motor, for selectively delivering electric power from the power source to the motor, including power circuit first and second terminals, and an activation duration limiting module within the power supply circuit and timed by liquid draining from a drain vessel, where the presence of a sufficient quantity of the liquid in the vessel causes the power circuit terminals to make electrical contact with each other and thereby completes the power circuit, activating the motor, and where the circuit remains complete and the motor activated until enough of the liquid has drained from the vessel to decrease the quantity of the liquid to a level below the sufficient quantity, and thereby causes the power circuit terminals to electrically disconnect.

The first and second terminals are for two embodiments resiliently biased apart from each other, and the presence of a sufficient quantity of the liquid within the vessel causes a mechanical displacement which closes the power circuit terminal together, and where the draining of the liquid to a level below the sufficient quantity reverses the mechanical displacement and thereby permits the terminals to separate from each other and thus to deactivate the motor.

The vehicle preferably additionally includes a lift mechanism including a mechanism for elevating the drive wheel while the liquid is poured into the vessel for permitting complete vessel filling prior to acceleration and spillage resulting from the acceleration and for lowering the drive wheel to cause a rapid vehicle acceleration. The vehicle preferably further includes a hollow shell body substantially surrounding and secured to the chassis. The motor is preferably activated by pouring a certain quantity of the liquid into the drain vessel.

The vehicle preferably additionally includes a liquid filling tube having a first tube end in fluid communication with the vessel and a second tube end higher than the first tube end for receiving the liquid and delivering the liquid into the vessel, where the filling tube is configured to resemble a vehicle gasoline pipe. The vehicle preferably further includes a liquid collection tank, and a vessel drain opening creating fluid communication with the liquid collection tank, permitting the liquid to flow gradually from the vessel into the liquid collection tank.

The drain vessel preferably includes a vessel side wall defining an open liquid receiving top end and narrowing to a drain opening at the bottom end, and the collection tank preferably includes a tank bottom wall, a tank side wall extending upwardly from the tank bottom wall, and a tank cap structure including a cap structure top wall fitted onto the upper end of the tank side wall, and a downwardly sloping funnel region in the tank top wall with a central funnel opening, the funnel region being encircled by an upwardly extending funnel region side wall, and a lateral opening in the cap structure side wall through which a substantially horizontal funnel lever is pivotally mounted, the funnel lever having secured to its inner end the drain vessel, and the funnel lever outer end including a counterweight mass and terminal contact structures, the arm being positioned adjacent to the motor power circuit electric terminals, the terminals being biased to move apart from and out of contact with each other, so that the liquid is poured into the vessel, and the weight of the liquid in the vessel offsets the counterbalancing of the counterweight mass and tilts the vessel and the lever inward end downwardly, thereby simultaneously pivoting of the contact structures against the first terminal, pressing the first terminal against the second terminal and thereby closing the motor power circuit, and so that the liquid in the cup structure progressively drains through the opening in the bottom of the vessel and into the collection tank, and the combined weight of the vessel and the liquid remaining in the vessel becomes progressively less until a point is reached at which the weight of the counterweight mass exceeds the weight of the vessel and the liquid remaining in the vessel, causing the lever to pivot back to its initial position, and moving the contact structures off the first terminal, so that the biasing of the first terminal again separates the terminals and opens the power circuit to deactivate the motor.

The vehicle preferably additionally includes a lid fitted onto the funnel region side wall, including an annular funnel region top wall, a lateral top wall flange, the top wall being annular and defining a central opening bordered by a perpendicularly oriented, liquid-receiving tube, the tube opening directly over the cup structure open top end for delivering liquid into the vessel open top end. The vehicle preferably additionally includes a drain port in the collection tank and a removable drain plug in the drain port for periodically draining the liquid from the tank. The collection tank preferably additionally includes a baffle structure secured within the collection tank for damping movement of the liquid within the collection tank.

The drain vessel alternatively includes a tubular vessel side wall and a vessel top wall sealingly interconnected to the vessel side wall and including a vessel receiving port for receiving liquid and wherein the vessel side wall includes at its lower end a lateral liquid discharge port, a deflection diaphragm sized to fit against the lower end of the vessel side wall, and a sealing and securing diaphragm frame member, where the first and second terminals are positioned below the deflection diaphragm, so that the first terminal is adjacent to the lower face of the defection diaphragm, and so that the liquid is poured into the vessel through the vessel receiving port and the weight of the liquid within the vessel progressively deflects the deflection diaphragm downwardly against the first terminal, until the quantity of the liquid within the vessel reaches a certain level at which the weight of the liquid within the vessel sufficiently deflects the diaphragm and thus the first terminal downwardly to cause the first terminal to abut and make electrically conducting contact with the second terminal and to thereby close and complete the motor power circuit, and so that liquid subsequently drains from the vessel through the liquid discharge port until the deflection diaphragm resiliently deflects upwardly to its rest position and the first terminal also pivots upwardly and out of contact with the second terminal and opens the motor power circuit. The diaphragm frame member is preferably an annular member of L-shaped cross-section having legs, one leg of the L-shape fitting snugly around the outside of the vessel side wall lower end and the other leg extending underneath and holding the diaphragm in place. The vehicle preferably additionally includes a sealing agent placed between the frame member and the vessel side wall and between the frame and the diaphragm. The vessel receiving port preferably includes an upwardly extending receiving port flange. The liquid discharge port preferably includes an outwardly extending discharge port flange. The first terminal optionally includes a broad circular middle section for making broad contact with the diaphragm, and a terminal separator made of insulating material located between first ends of the terminals. Each terminal preferably has a terminal free end opposite the first end which includes a conductive protrusion directed toward the other terminal for making electrical contact with the opposing protrusion.

The lift mechanism preferably includes a rearwardly directed lever attached to a fulcrum pin in each side of the rear of the vehicle, where at least one of the rear wheels is the drive wheel, a connection bar interconnecting the levers, a leg segment having a leg segment tip and extending generally downwardly from each of the levers and being of sufficient length to abut the vehicle support surface below the level of the rear wheels, so that pivoting the connection bar and levers downwardly pivots the leg segments against the support surface and lifts the drive wheel off the support surface, and so that the friction of the leg segments against the support surface holds the leg segments in this position until the user pivots the connection bar and levers upwardly and thereby swings the tips of the leg segments rearwardly and upwardly, in turn thereby lowering the drive wheel into contact with the support surface.

The drain vessel still alternatively includes a tubular vessel side wall, a vessel bottom wall sealingly connected to the vessel side wall, and a vessel top wall sealingly interconnected to the vessel side wall and including a vessel receiving port for receiving liquid and where the vessel side wall includes at its lower end a lateral liquid discharge port, where the first terminal and the second terminal extend within the vessel and are spaced apart from the vessel bottom wall, and so that the liquid is poured into the vessel through the vessel receiving port, and so that contact between the liquid and both the first terminal and the second terminal electrically connects the first terminal and the second terminal to complete the motor power circuit, and so that liquid subsequently drains from the vessel through the liquid discharge port until the level of the liquid within the vessel falls below and out of contact with the first terminal and second terminal, electrically disconnecting the terminals and opening the motor power circuit.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
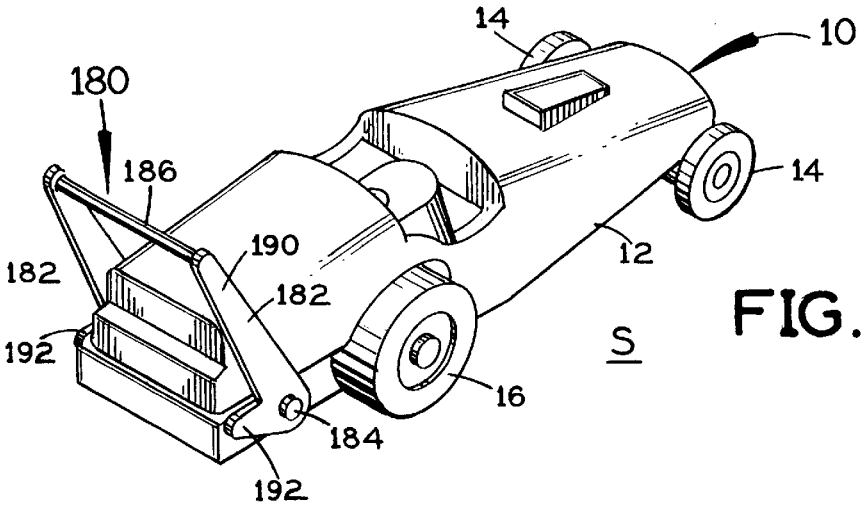
FIG. 1 is a perspective view of the complete vehicle of the preferred embodiment, showing the rear mounted lift mechanism.
Figure 2:
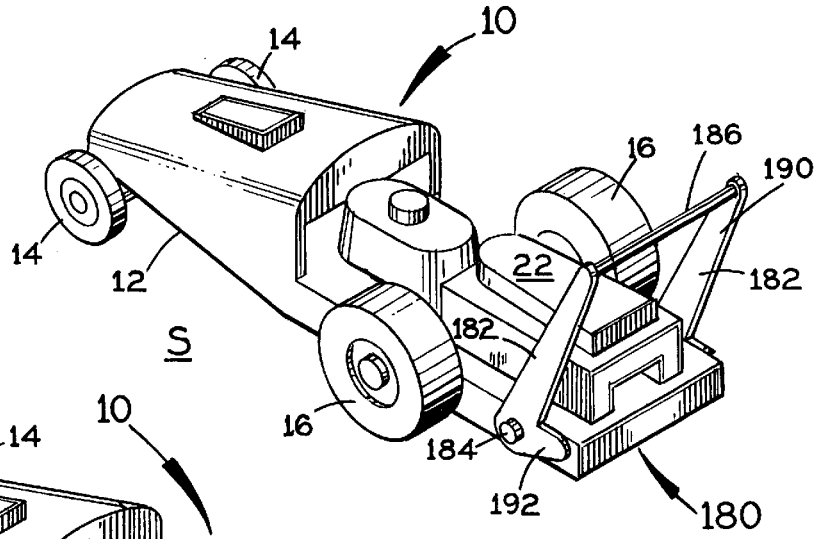
FIG. 2 is a perspective view of the vehicle with the shell removed from the chassis, showing the lift mechanism in the rear wheel lifting mode.
Figure 3:
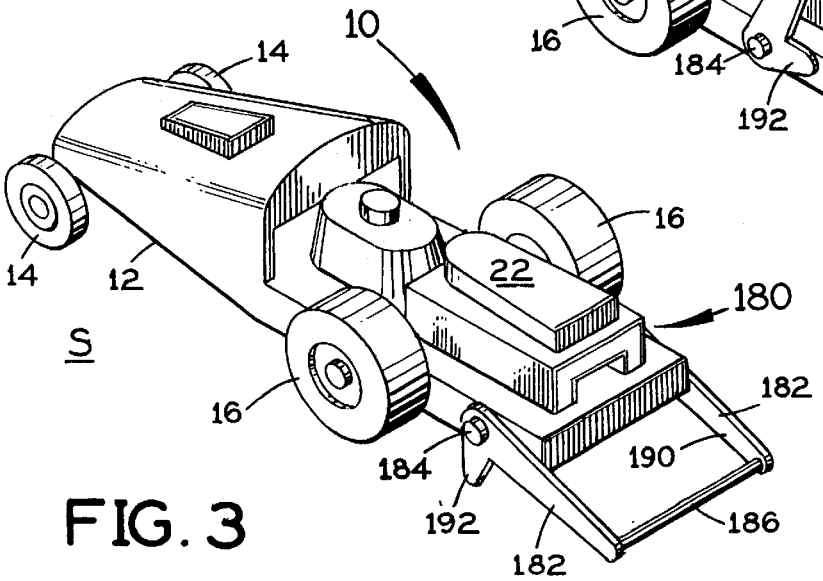
FIG. 3 is a view as in FIG. 2 except that the lift mechanism is shown pivoted to lower the rear wheels into contact with the support surface.
Figure 4:
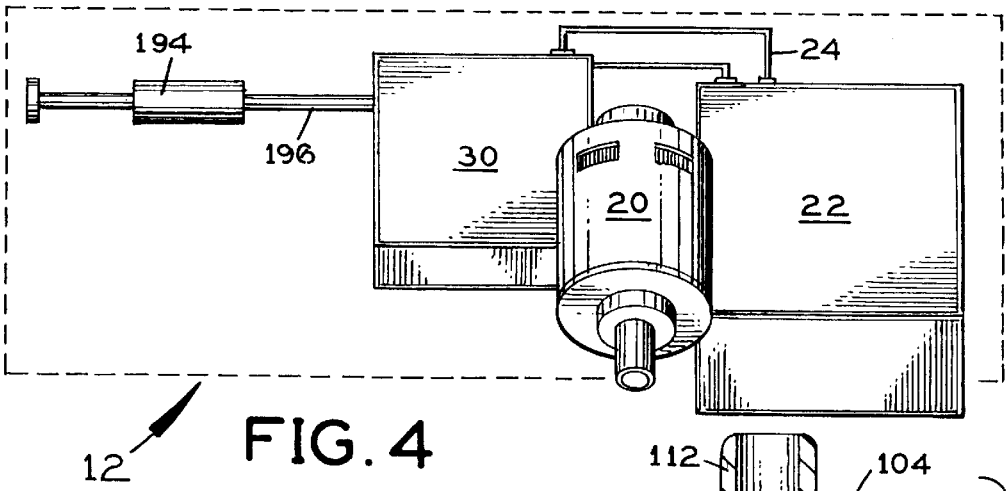
FIG. 4 is a schematic top view of the chassis showing the preferred locations of the motor, batteries and module relative to each other.
Figure 7:
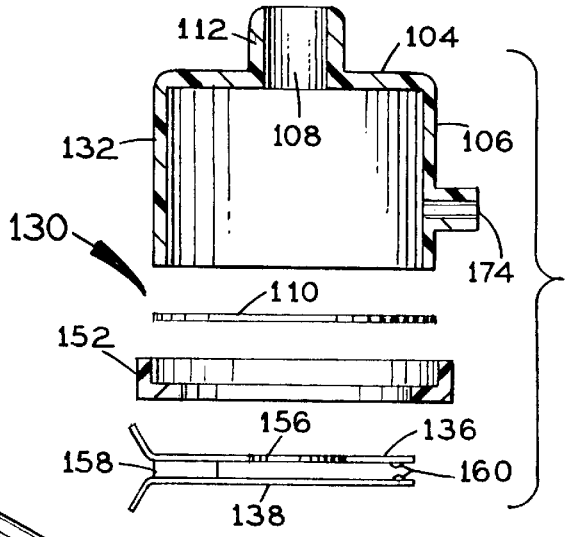
FIG. 7 is an exploded cross-sectional side view of the second preferred module having the deflection diaphragm which bears against one of the contacts when deflected with the weight of liquid in the vessel, closing the contacts and completing the motor power circuit.
Figure 8:
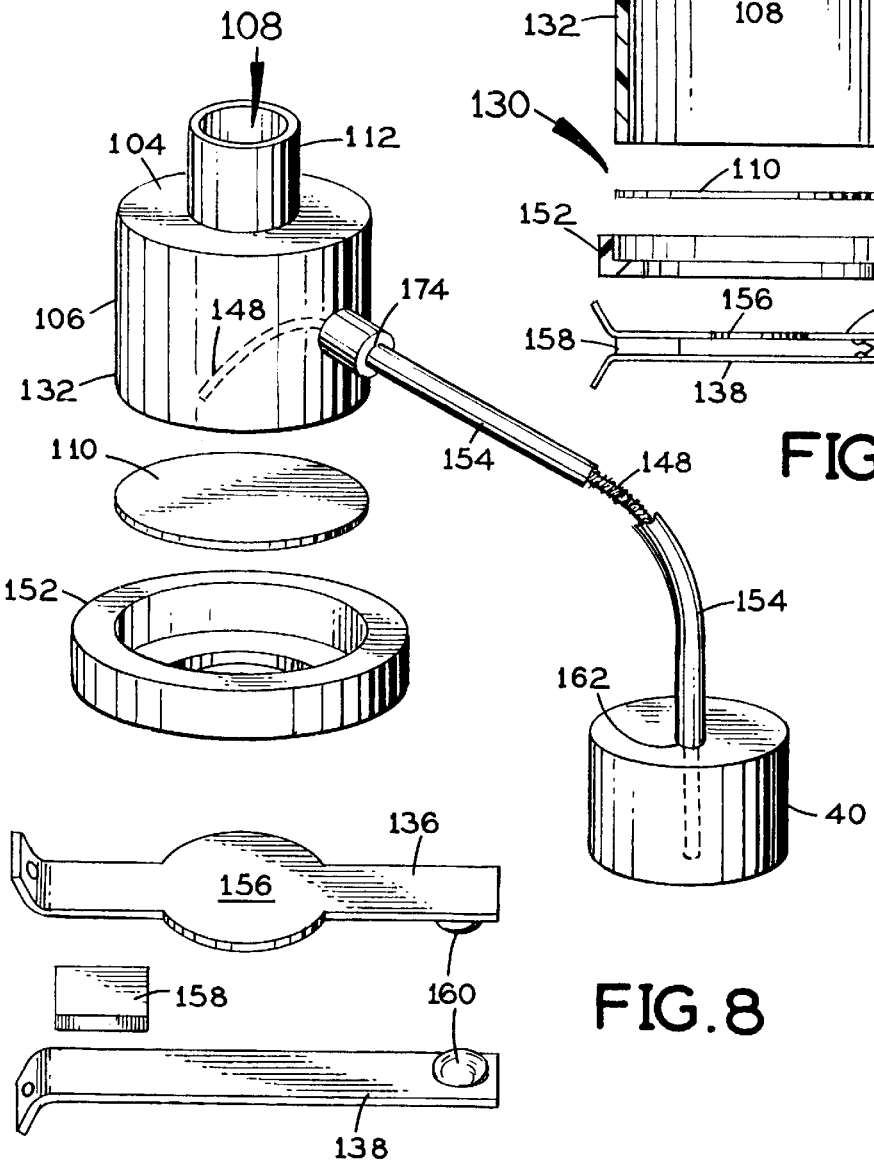
FIG. 8 is an exploded perspective view otherwise as in FIG. 7, additionally showing the receiving tank and wick delivery mechanism extending from the drain vessel to the tank.
Figure 5:
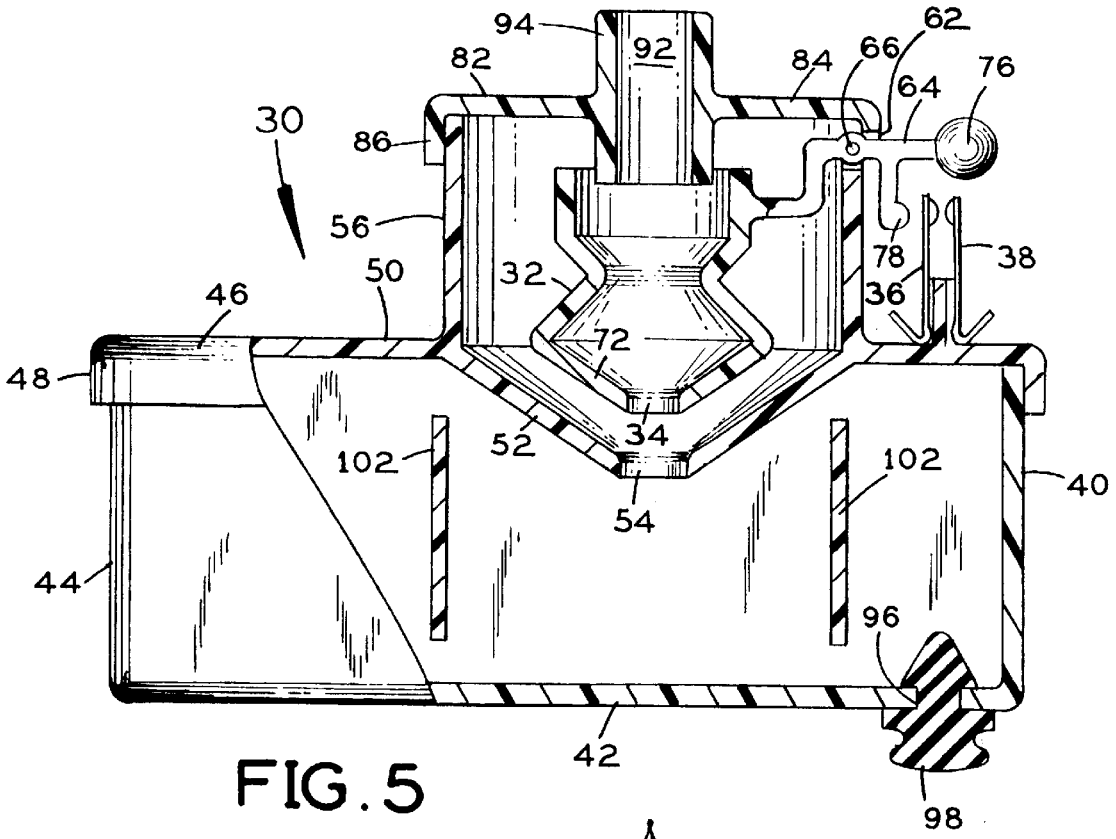
FIG. 5 is cross-section side view of the first preferred module having the drain vessel at one end of a pivoting lever and a counterbalance mass at the other end.
Figure 6:
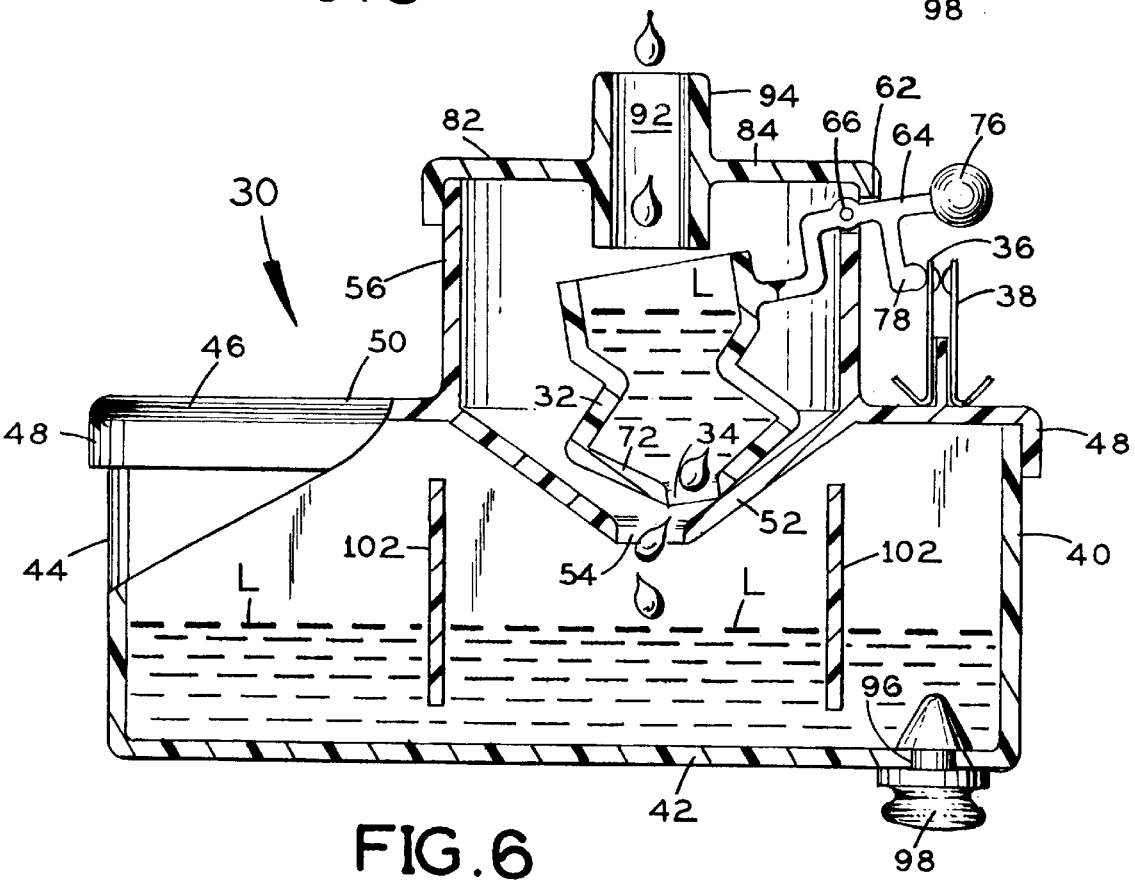
FIG. 6 is a view as in FIG. 5, but with liquid added to the drain vessel, in turn adding weight to the vessel and offsetting the weight of the counterbalance mass, pivoting the arm against and closing the electric contacts to complete the motor power circuit, and showing the liquid in the vessel draining into the tank below.
Figure 9:
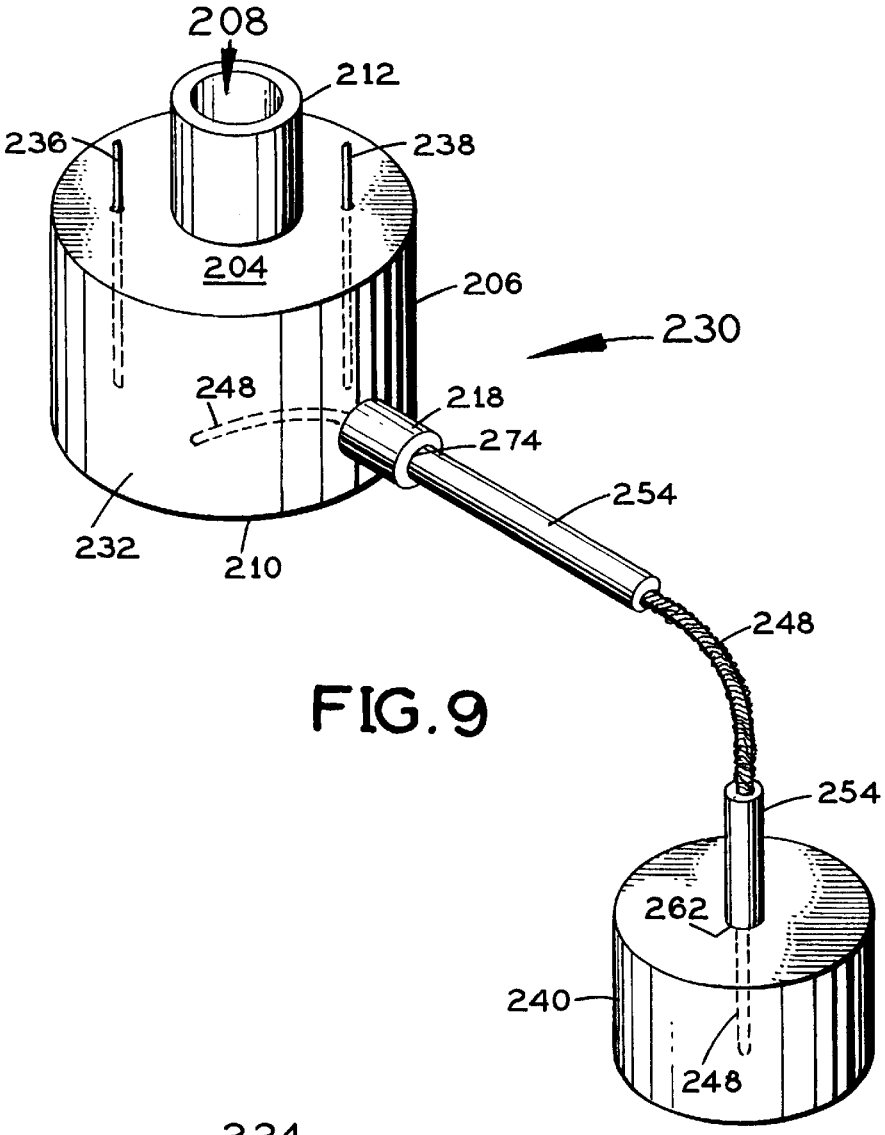
FIG. 9 is a perspective view of the vessel and receiving tank of the third preferred module having liquid detecting electric terminals extending into the vessel upper end.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

Preferred Embodiments

Referring to FIGS. 1–10, and specifically to FIGS. 1–4, a miniature vehicle 10 is disclosed, including a chassis 12 with two front and two rear support wheels 14 and 16, respectively, a hollow shell body 18, an electric motor 20 of conventional design drivably connected to the two rear support wheels 16, a battery power source 22 and a power supply circuit 24 for delivering power to motor 20, including an activation duration limiting module 30 timed by water or other suitable liquid L draining from a drain vessel 32 within module 30. A lift mechanism 180 is preferably provided to elevate rear wheels 16 off the vehicle support surface S while liquid L is being poured into vessel 32, to permit complete filling without spillage and to cause a patch-out take off.

The module 30 is seated within the vehicle 10 and motor 20 is activated by pouring the liquid L into vessel 32 through a filling tube 28 made to resemble a gasoline fill pipe. Vessel 32 includes a liquid drain opening 34 which permits the liquid L to escape gradually from vessel 32 into a secondary collection tank 40. The weight of the liquid L within vessel 32 causes a mechanical displacement which closes power circuit terminals 36 and 38 and thereby completes circuit 24, activating motor 20. Circuit 24 remains complete and the motor 20 activated until sufficient liquid L has escaped from vessel 32 to permit the terminals 36 and 38 to resiliently separate from each other, opening circuit 24 and deactivating motor 18.

A first module 30 embodiment includes a pivoting vessel 32 having a cup-shape and secondary collection tank 40 having a bottom wall 42, side walls 44 extending upwardly from bottom wall 42 outer edges, and a cap structure 50. See FIGS. 5 and 6. Cap structure 46 includes a tank top wall 46 having downwardly extending closure flanges 48 at its perimeter for fitting snugly over the upper ends of the upright tank side walls 44. In the middle area of tank top wall 46 is a downwardly sloping funnel region 52 with a central funnel opening 54, the funnel region 52 being encircled by an upwardly extending funnel region side wall 56. An lateral opening 62 is provided in funnel region side wall 56 through which a generally horizontal funnel lever 64 is pivotally mounted on a funnel lever pin 66. Funnel lever 64 has at its inner end the liquid L draining vessel 32 having an open liquid-receiving top end and narrowed side wall portion 72, below which vessel 32 slopes to a central vessel 32 drain opening 34. The funnel lever 64 outer end includes a counterweight ball 76 and a laterally protruding contact arm 78. Arm 78 is positioned immediately adjacent the motor power circuit electric terminals 36 and 38 which are spring-biased apart from each other. Funnel region side wall 56 preferably has a lid 82 including a funnel region top wall 84, a lateral top wall flange 86, and a central opening 92 bordered by a perpendicularly oriented, vertical liquid receiving tube 94. Tube 94 opens directly over the vessel 32 open top to guide and deliver liquid L into vessel 32.

Liquid L is poured into vertical tube 94 and flows into vessel 32. The weight of the liquid L within vessel 32 offsets the counterbalancing of ball 76 at the other end of funnel lever 64 and tilts vessel 32 and the lever 64 inward end downwardly. See FIG. 6. This pivoting of lever 64 also pivots contact arm 78 against the one of the spring-biased terminals 36, pressing it against the other terminal 38 and thereby closing the motor power circuit 24. The liquid L in vessel 32 slowly drains through the opening 54 in the bottom of cup structure 50 and into collection tank 40. As the liquid L drains, the combined weight of the vessel 32 and contained liquid L becomes progressively less, and a point is reached at which the weight of counterweight ball 76 exceeds the weight of vessel 32 and the contained liquid L, causing lever 64 to pivot back to its initial position, moving arm 78 off terminal 36, so that the spring-biasing of terminal 36 again separates terminals 36 and 38, and opens power circuit 24 to deactivate motor 20. A tank drain port 96 having a removable drain plug 98 in the bottom of collection tank 40 permits draining of tank 40 after use. It may take several vessel 32 drainings to fill tank 40, so that tank 40 emptying is not necessary for every activation of the vehicle motor 20. Tank baffle wall sections 102 are optionally provided to damp liquid L movement within liquid collection tank 40.

An alternative liquid drain module 130 is provided including a vessel 132 having a top wall 104 and a sealingly interconnected tubular side wall 106. See FIGS. 7 and 8. Top wall 104 includes a liquid receiving port 108 with an upwardly extending receiving port flange 112 and side wall 106 includes at its lower end a liquid discharge port 174 and an outwardly extending discharge port 174 flange. A drain tube 154 is sealingly fitted onto the discharge port 174 flange and to a flanged receiving port 162 on collection tank 40. A wick 148 constantly drains liquid L from vessel 32 through drain tube 154. Liquid L should be drained below the activation level to prevent unwanted activation through dropping of the vehicle 10, or by other such action. A circular resilient member or diaphragm 110 is sized to fit against the lower edge of side wall 106, and a sealing and securing diaphragm ring/frame 152 is provided in the form of an annular member of L-shaped cross-section, one leg of the L-shape fitting snugly around the outside of the side wall 106 lower end and the other leg extending underneath and holding diaphragm 110 in place. A suitable sealing agent (not shown) is placed between the frame 152 and side wall 106 and between the frame 152 and diaphragm 110. The terminals 136 and 138 are positioned generally horizontally below diaphragm 110, so that the first terminal 136, which is spring-biased away from the second terminal 138, is adjacent the middle of the diaphragm 110 lower face. The first terminal 136 preferably includes a broad circular middle section 156 for making broad contact with the diaphragm 110, and a terminals separator 158 made of insulating material is provided between the fastened ends of terminals 136 and 138. Each terminal 136 and 138 free end includes a conductive protrusion 160 directed toward the other terminal for making electrical contact with the opposing protrusion 160.

Liquid L is poured into the liquid receiving port and the weight of the liquid progressively deflects the middle of diaphragm 110 downwardly against first terminal 136. When the quantity of liquid L reaches a certain level, the weight of the liquid in vessel 32 sufficiently deflects first terminal 136 downwardly to cause the two protrusions 160 to meet and complete the motor power circuit 24. The level of liquid L is filled beyond this point of contact, so that extra liquid L can drain off through the liquid discharge port 174 while contact is maintained and provide the activation duration desired. The selected quantity of liquid L beyond that needed to close circuit 24 in combination with the selected diameter of the liquid discharge port 174 determine the precise duration of motor 20 activation before enough liquid L drains out of the vessel 32 to cause the resilient diaphragm 110 to deflect back upwardly so that the biasing of the first terminal 136 separates the protrusions 160 and opens the motor power circuit 24.

Figure 10:
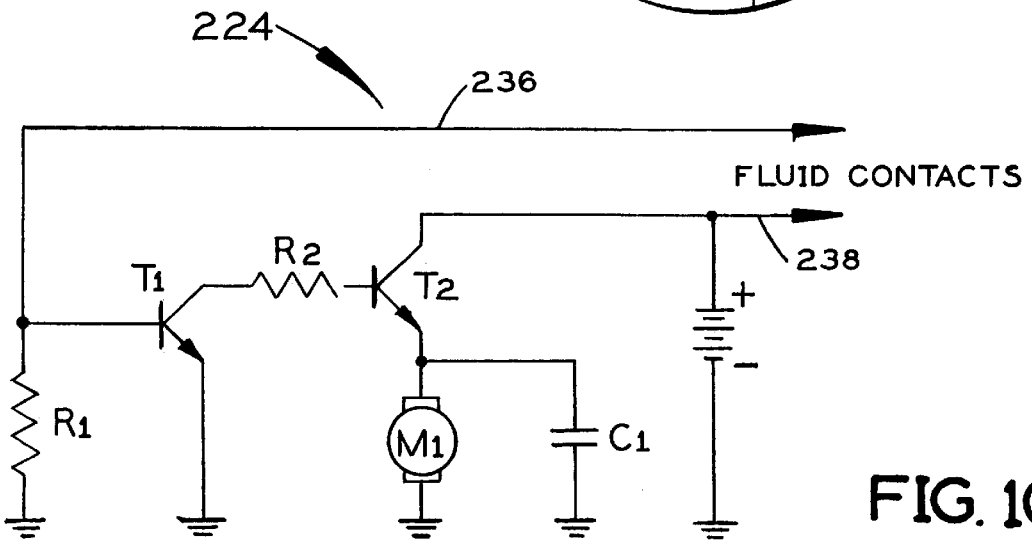
FIG. 10 is a preferred circuit diagram for the power supply circuit having the electric terminals of the third preferred module.

A third module embodiment 230 for vehicle 10 provides electronic monitoring of the liquid L level. See FIG. 9. A drain vessel 232 similar to vessel 130 of second module embodiment 130 includes a vessel top wall 204 having a liquid L receiving port 208, a vessel tubular side wall 206, and a bottom wall 210. For this embodiment, bottom wall 210 is substantially rigid, and integral with side wall 206. A liquid receiving port tubular flange 212 encircles port 208. A lateral discharge port 274 is provided at the lower end of tubular side wall 206, and is encircled by a tubular discharge port flange 218. A modified power supply circuit 224 is provided, preferably as illustrated in FIG. 10, which both delivers power to motor 20 and detects the liquid L level in vessel 232. Circuit 224 includes a pair of laterally spaced apart electric terminals 236 and 238 which extend downwardly into vessel 232 but, remaining a distance above bottom wall 210. The liquid L contains an electrolyte so that terminals 236 and 238 become electrically connected when liquid L is present at a level reaching the lower ends of terminals 236 and 238. A very low amount of current flowing between terminals 236 and 238, causes circuit 224 to delivery a much higher current to motor 20. When the volume of liquid L drops below this level, electrical contact between terminals 236 and 238 is broken and the motor powering portion of the circuit 224 is opened. Terminals 236 and 238 are preferably zinc plated or are zinc probes such as screws.

One end of a drain tube 254 is preferably fitted snugly onto discharge port flange 218, and the other end of drain tube 254 is preferably secured to a receiving port 262 on a receiving tank 240, positioned below the level of vessel 232.

As in the diaphragm version described above, a wick 248 preferably extends through drain tube 254 into vessel 232 and into tank 240 to draw liquid L down into tank 240.

To prevent the vehicle 10 from accelerating away from the user before the filling of the vessel 32 is completed, a lift mechanism 180 mentioned above is provided. The preferred lift mechanism 180 includes a rearwardly directed lift lever 182 attached to a fulcrum pin 184 in each side of the rear of the vehicle 10, where the support rear wheels 16 are drivably connected to the motor 20. The lift levers 182 are interconnected by a connection bar 186 extending between the rearmost lift lever 182 ends. Each lift lever 182 includes a leg segment 192 extending generally downwardly from the lever 182 and being of sufficient length to abut the vehicle support surface S below rear wheels 16, such that pivoting the combined lever structure 190 downwardly pivots leg segments 192 against the support surface S and lifts the rear of vehicle 10 so that rear wheels 16 are off support surface S. The friction of the tips of the leg segments 192 against the support surface S holds the leg segment 192 in this downward, vehicle-elevating position until the user pivots the combined lever structure 190 upwardly and thereby swings the leg segment 192 tips rearwardly and upwardly, rapidly lowering the vehicle 10 rear wheels 16 into contact with the support surface S. Since the vessel 32 would already have been filled prior to lowering, the motor 20 is activated and the rear wheels 16 are already spinning. The spinning wheels 16 hit the support surface S and cause vehicle 10 to patch out in an exciting wheel-spinning fashion and to accelerate quickly.

An optional and preferred feature is a chassis weight distribution selection mass 194 having a diametric bore (not shown) which is slidable longitudinally along chassis 12 on a slide rod 196 fitted through the diametric bore. See FIG. 4. Sliding mass 194 toward the front of vehicle 10 transfers loading off the rear wheels 16 to minimize rear wheel friction and to permit rear wheel 16 spinning upon starting. Sliding mass 194 toward the rear of vehicle 10 places greater loading on rear wheels 16 for increased traction and a more rapid acceleration, and when placed in the extreme rearward position also causes a wheel stand upon starting of acceleration in which front wheels 14 lift off support surface S for a moment.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A vehicle for entertainment, comprising:

a chassis with a plurality of support wheels, wherein at least one said support wheel is a drive wheel, an electric motor drivably connected to said drive wheel, an electric power source, a power supply circuit interconnecting said power source and said motor, for selectively delivering electric power from said power source to said motor, including power circuit first and second terminals, and an activation duration limiting module within said power supply circuit, said module comprising a drain vessel for receiving liquid having a drain port for metered release of said liquid from said drain vessel, and liquid weight sensing means, wherein the weight of a certain minimal quantity of said liquid in said vessel is detected by said weight sensing means which in turn causes said power circuit terminals to make electrical contact with each other and thereby completes said power circuit, activating said motor, and wherein said circuit remains complete and said motor activated until enough of said liquid has drained from said vessel to decrease the weight of said liquid to a level below said certain minimal quantity, said decreased weight being detected by said weight sensing means, whereupon said weight sensing means causes said power circuit terminals to electrically disconnect.

2. A vehicle according to claim 1, wherein said first and second terminals are resiliently biased apart from each other, and the presence of a certain minimal quantity of said liquid within said vessel causes a mechanical displacement which closes said power circuit terminal together, and wherein the draining of said liquid to a level below said certain minimal quantity reverses said mechanical displacement and thereby permits said terminals to separate from each other and thus to deactivate said motor.

3. A vehicle according to claim 2, additionally comprising:

a lift mechanism comprising means for elevating said drive wheel while said liquid is poured into said vessel for permitting complete vessel filling prior to acceleration and prior to any spillage resulting from said acceleration and for lowering said drive wheel to cause a rapid vehicle acceleration.

4. A vehicle according to claim 2, additionally comprising:

a hollow shell body substantially surrounding and secured to said chassis.

5. A vehicle according to claim 2, additionally comprising a liquid filling tube having a first tube end in fluid communication with said vessel and a second tube end higher than said first tube end for receiving said liquid and delivering said liquid into said vessel, wherein said filling tube is configured to resemble a vehicle gasoline pipe.

6. A vehicle according to claim 2, additionally comprising a liquid collection tank, and a vessel drain opening creating fluid communication with said liquid collection tank, permitting said liquid to flow gradually from said vessel into said liquid collection tank.

7. A chassis with a plurality of support wheels, wherein at least one said support wheel is a drive wheel, an electric motor drivably connected to said drive wheel, an electric power source, a power supply circuit interconnecting said power source and said motor, for selectively delivering electric power from said power source to said motor, including power circuit first and second terminals, an activation duration limiting module within said power supply circuit and timed by liquid draining from a drain vessel, and a liquid collection tank, and a vessel drain opening creating fluid communication with said liquid collection tank, permitting said liquid to flow gradually from said vessel into said liquid collection tank, wherein the presence of a certain minimal quantity of said liquid in said vessel causes said power circuit terminals to make electrical contact with each other and thereby completes said power circuit, activating said motor, and wherein said circuit remains complete and said motor activated until enough of said liquid has drained from said vessel to decrease the quantity of said liquid to a level below said certain minimal quantity, and thereby causes said power circuit terminals to electrically disconnect, wherein said first and second terminals are resiliently biased apart from each other, and the presence of a certain minimal quantity of said liquid within said vessel causes a mechanical displacement which closes said power circuit terminal together, and wherein the draining of said liquid to a level below said sufficient quantity reverses said mechanical displacement and thereby permits said terminals to separate from each other and thus to deactivate said motor, wherein said drain vessel comprises a vessel side wall defining an open liquid receiving top end and narrowing to a drain opening at the bottom end, and wherein said collection tank comprises a tank bottom wall, a tank side wall extending upwardly from said tank bottom wall, and a tank cap structure including a cap structure top wall fitted onto the upper end of said tank side wall, and a downwardly sloping funnel region in said tank top wall with a central funnel opening, said funnel region being encircled by an upwardly extending funnel region side wall, and a lateral opening in said cap structure side wall through which a substantially horizontal funnel lever is pivotally mounted, said funnel lever having secured to its inner end said drain vessel, and said funnel lever outer end including a counterweight mass and terminal contact means, said arm being positioned adjacent to said motor power circuit electric terminals, said terminals being biased to move apart from and out of contact with each other, such that said liquid is poured into said vessel, and the weight of the said liquid in said vessel offsets the counterbalancing of said counterweight mass and tilts said vessel and said lever inward end downwardly, thereby simultaneously pivoting said contact means against said first terminal, pressing said first terminal against a second said terminal and thereby closing said motor power circuit, and such that said liquid in said cap structure progressively drains through the opening in the bottom of said vessel and into said collection tank, and the combined weight of said vessel and the liquid remaining in said vessel becomes progressively less until a point is reached at which the weight of the counterweight mass exceeds the weight of said vessel and said liquid remaining in said vessel, causing said lever to pivot back to its initial position, and moving said contact means off said first terminal, such that the biasing of said first terminal again separates said terminals and opens said power circuit to deactivate said motor.

8. A vehicle according to claim 7, additionally comprising a lid fitted onto said funnel region side wall, comprising an annular funnel region top wall, a lateral top wall flange, said top wall being annular and defining a central opening bordered by a perpendicularly oriented, liquid-receiving tube, said tube opening directly over said cap structure open top end for delivering liquid into said vessel open top end.

9. A vehicle according to claim 7, additionally comprising a drain port in said collection tank and a removable drain plug in said drain port for draining said liquid from said tank.

10. A vehicle according to claim 7, wherein said collection tank additionally comprises baffle means secured within said collection tank for damping movement of said liquid within said collection tank.

11. A chassis with a plurality of support wheels, wherein at least one said support wheel is a drive wheel, an electric motor drivably connected to said drive wheel, an electric power source, a power supply circuit interconnecting said power source and said motor, for selectively delivering electric power from said power source to said motor, including power circuit first and second terminals, and an activation duration limiting module within said power supply circuit and timed by liquid draining from a drain vessel, wherein the presence of a certain minimal quantity of said liquid in said vessel causes said power circuit terminals to make electrical contact with each other and thereby completes said power circuit, activating said motor, and wherein said circuit remains complete and said motor activated until enough of said liquid has drained from said vessel to decrease the quantity of said liquid to a level below said certain minimal quantity, and thereby causes said power circuit terminals to electrically disconnect, wherein said first and second terminals are resiliently biased apart from each other, and the presence of a certain minimal quantity of said liquid within said vessel causes a mechanical displacement which closes said Power circuit terminal together, and wherein the draining of said liquid to a level below said sufficient quantity reverses said mechanical displacement and thereby permits said terminals to separate from each other and thus to deactivate said motor, wherein said drain vessel comprises a tubular vessel side wall and a vessel top wall sealingly interconnected to said vessel side wall and comprising a vessel receiving port for receiving liquid and wherein the vessel side wall includes at its lower end a lateral liquid discharge port, a deflection diaphragm sized to fit against the lower end of said vessel side wall, and a sealing and securing diaphragm frame member, wherein said first and second terminals are positioned below said deflection diaphragm, such that said first terminal is adjacent to the lower face of said defection diaphragm, and such that said liquid is poured into said vessel through said vessel receiving port and the weight of said liquid within said vessel progressively deflects said deflection diaphragm downwardly against said first terminal, until the quantity of said liquid within said vessel reaches a certain level at which the weight of said liquid within said vessel sufficiently deflects said diaphragm and thus said first terminal downwardly to cause said first terminal to abut and make electrically conducting contact with said second terminal and to thereby close and complete said motor power circuit, and such that liquid subsequently drains from said vessel through said liquid discharge port until said deflection diaphragm resiliently deflects upwardly to its rest position and said first terminal also pivots upwardly and out of contact with said second terminal and opens said motor power circuit.

12. A vehicle according to claim 11, wherein said diaphragm frame member is an annular member of L-shaped cross-section having legs, one leg of the L-shape fitting snugly around the outside of said vessel side wall lower end and the other leg extending underneath and holding said diaphragm in place.

13. A vehicle according to claim 12, additionally comprising a sealing agent placed between said frame member and said vessel side wall and between said frame and said diaphragm.

14. A vehicle according to claim 11, wherein said vessel receiving port comprises an upwardly extending receiving port flange.

15. A vehicle according to claim 11, wherein said liquid discharge port comprises an outwardly extending discharge port flange.

16. A vehicle according to claim 11, wherein the first said terminal includes a broad circular middle section for making broad contact with said diaphragm, and a terminal separator made of insulating material is provided between first ends of said terminals.

17. A vehicle according to claim 16, wherein each terminal has a terminal free end opposite said first end which includes a conductive protrusion directed toward the other said terminal for making electrical contact with the opposing said protrusion.

18. A chassis with a plurality of support wheels, wherein at least one said support wheel is a drive wheel, an electric motor drivably connected to said drive wheel, an electric power source, a power supply circuit interconnecting said power source and said motor, for selectively delivering electric power from said power source to said motor, including power circuit first and second terminals, and an activation duration limiting module within said power supply circuit and timed by liquid draining from a drain vessel, wherein the presence of a sufficient quantity of said liquid in said vessel causes said power circuit terminals to make electrical contact with each other and thereby completes said power circuit, activating said motor, and wherein said circuit remains complete and said motor activated until enough of said liquid has drained from said vessel to decrease the quantity of said liquid to a level below said sufficient quantity, and thereby causes said power circuit terminals to electrically disconnect, a lift mechanism comprising means for elevating said drive wheel while said liquid is poured into said vessel for permitting complete vessel filling prior to acceleration and prior to any spillage resulting from said acceleration and for lowering said drive wheel to cause a rapid vehicle acceleration, wherein said first and second terminals are resiliently biased apart from each other, and the presence of a sufficient quantity of said liquid within said vessel causes a mechanical displacement which closes said power circuit terminal together, and wherein the draining of said liquid to a level below said sufficient quantity reverses said mechanical displacement and thereby permits said terminals to separate from each other and thus to deactivate said motor, wherein said lift mechanism comprises:

a rearwardly directed lever attached to a fulcrum pin in each side of the rear of said vehicle, wherein at least one of said rear wheels is said drive wheel, a connection bar interconnecting said levers, a leg segment having a leg segment tip and extending generally downwardly from each said lever and being of sufficient length to abut the vehicle support surface below the level of said rear wheels, such that pivoting said connection bar and levers downwardly pivots said leg segments against the support surface and lifts said drive wheel off the support surface, and such that the friction of said leg segments against the support surface holds said leg segments in this position until the user pivots said connection bar and levers upwardly and thereby swings the tips of said leg segments rearwardly and upwardly, in turn thereby lowering said drive wheel into contact with the support surface.

* * * * *